US005661854A

United States Patent [19]

March, II

[11] Patent Number: 5,661,854

[45] Date of Patent: Sep. 2, 1997

[54] FLEXIBLE HELMET

[76] Inventor: Richard W. March, II, P.O. Box 264, Franklinton, N.C. 27525

[21] Appl. No.: 695,409

[22] Filed: Aug. 12, 1996

Related U.S. Application Data

[63] Continuation-in-part of Ser. No. 299,532, Sep. 1, 1994, Pat. No. 5,544,367.

[51] Int. Cl.[6] ..... A42B 3/00

[52] U.S. Cl. ..... 2/410; 2/411

[58] Field of Search ..... 2/410, 411, 412, 2/414, 420, 425, 417, 418, 6.1, 6.2, 6.3, 6.6

[56] References Cited

U.S. PATENT DOCUMENTS

| | | | |
|---|---|---|---|
| 2,706,294 | 4/1955 | Sprinkle | 2/414 |
| 2,717,384 | 9/1955 | Frothingham | 2/414 |
| 3,784,984 | 1/1974 | Aileo | 2/410 |
| 3,786,519 | 1/1974 | Aileo | 2/6 |
| 4,023,209 | 5/1977 | Frieder | 2/6 |
| 4,843,642 | 7/1989 | Brower | 2/6 |
| 5,173,970 | 12/1992 | Shifrin | 2/410 |

*Primary Examiner*—Michael A. Neas

[57] ABSTRACT

A flexible protective helmet assembly comprising an outer layer of impact resistant segments (11–17) overlying an inner layer of closely abutting impact resistant and energy absorbent structures (18–24) fixedly attached and interconnected by flexible elastic panels (26–32) and including an elliptically annular crown structure (25).

8 Claims, 6 Drawing Sheets

FLEXIBLE HELMET

This application is a continuation in part of U.S. application Ser. No. 08/299,532 filed Sep. 1, 1994, now U.S. Pat. No. 5,544,367.

FIELD OF THE INVENTION

This invention relates generally to protective helmet assemblys and particularly to those helmets which incorporate structural means for responding to the shape and size of the wearer's head.

BACKGROUND OF THE INVENTION

The need for a significantly protective helmet of reduced bulk and very thin silhouette has existed for many years in several athletic and entertainment sports, and in some cases, military applications. The purposes creating this need and which such a helmet should provide are maximum maneuverability or very low aerodynamic resistance depending on the helmet's intended use. Protection of the wear's head from impacts however, remains a priority over this need. The prior art consistently demonstrates this priority being provided for by the use of substantially unitary, rigid outer shells. These shells, normally lined with a variety of impact absorbing materials, must be constructed large enough to accommodate additional padding structures or lining assemblys primarily for the purpose of responding to the wearer's head shape, and to a limited degree, the size of the wearer's head. The use of such padding or structures therefore, requires a corresponding increase in the helmets's overall bulk adversely affecting it's dimensional profiles, stability, and aerodynamic resistance. The conflict between the priority of providing adequate protection and the need for a helmet of very low bulk or aerodynamic resistance has been approached by the prior art only indirectly on a very limited basis. Attempts to provide a solution to this problem have incorporated the use of flexible or elastic fabric. Typical of this approach for example, is that shown in U.S. Pat. Nos. 3,784,984 (1974) to Aileo and 4,023,209 (1977) to Frieder, Jr. et al. In these patents a helmet liner is constructed of fabric mesh formed into pockets into which a series of energy absorbent pads are inserted. The use of elastic mesh in these helmets is intended to provide some degree of flexible response to the wearer's head shape and size. This ability however, is severely contradicted by the copious use of non-elastic reinforcing tapes at the margins of various panels, restricting the elastic function of those panels.

The most significant problem inherent in the prior art however, as exemplified in part by the above patents, is the vulnerability to impacts at locations where various padding structures are approximately adjacent with intentional spacing. The problem also occurs at the margins and regions of internal earcup assemblys utilized for sound attenuation and communications in military applications. This weakness also occurs in a similar manner at indentations in a single unitary pad as shown in U.S. Pat. No. 4,843,642 (1989) to Brower. An increased degree of abutment of sections is claimed to occur at these indentations upon a radial impact to adjacent sections. Although the helmet dispenses with the use of an overlying outer shell, no feature is present to protect the wearer's head form impacts at the locations of these indentations.

Recognizing these vulnerabilitys, the prior art teaches that provision for full impact protection must revert to the concept of the use of rigid, substantially unitary outer shells or an assembly of parts embracing this approach. Due to the relatively inflexible nature of these shells they present an increased overall bulk in their silhouette with a corresponding increase in weight and diminished maneuverability. They do not present streamlined compact conformity to the wearer's head, but rather, objectionable encumbrances in that regard. In the above patents where the wearer is provided the option of foregoing the use of these outer shells, offered as demountable accessories, the wearer must endure the inconvenience of additional inventory, transport and assembly of multiple components for full protection.

OBJECTIVES AND SUMMARY OF THE INVENTION

One object of the current invention is to provide protection from impacts to the wearer equivalent to the outer shells of the prior art without the use of a unitary rigid outer shell structure or a static assembly of components substantially embracing that approach to protection.

A further objective of the invention is to provide a helmet with minimum bulk and weight which presents a compact, thin silhouette with significantly increased maneuverability and reduced aerodynamic resistance relative to the prior art.

A further objective of the invention is to provide a protective helmet with the above qualities which exhibits maximum response and conformity to the wearer's head shape and size without the use of additional padding or adjustable devices for that purpose such as appears in the prior art.

The invention comprises a flexible helmet constructed of an inner layer of padded segments of relatively rigid material attached to each other by panels of elastic material which interconnects them with an overlying outer layer of relatively rigid segments of material absent of padding and includes a crown structure. The segments of the inner layer extend longitudinally from the crown structure and are held in close abutment along their longitudinal margins by the elastic panels. The elastic panels also position the outer segments, which also extend longitudinally from the crown structure, over the longitudinal abutments of the inner layer of segments. The longitudinal margins of the outer layer of segments therefore overlap the longitudinal margins of any two abutting inner segments. This approach provides a flexible and elastic helmet with superior responsiveness and conformity to the wearer's head shape and size and permits a very compact assembly with streamlined aerodynamic resistance and maximum maneuverability.

It will therefore be apparent to one skilled in the art, here and in the detailed description to follow, that this departure in concept relative to the prior art accomplishes the objectives of the invention.

BRIEF DESCRIPTION OF THE DRAWINGS

In the drawings which are to read in conjunction with the Specification and the detailed description to follow.

DETAILED DESCRIPTION OF THE INVENTION

In the following text the term longitudinal is to be interpreted as referring generally to vertical and interchangeably to both the sagittal (anterior-posterior) and coronal (side to side) planes of the helmet. The term lateral is to be interpreted as referring generally to horizontal and approximately perpindicular to longitudinal. Terms of orientation contemplate the helmet in use with the wearer's head in substantially an upright position. The term segment refers to a section of sheet-like material which has been molded or heat formed appropriately for its' location as shown in the accompanying illustrations, relative to the generally hemispherical shape of the human head. The term structure refers to a segment of material to which energy absorbent padding has been laminated or cemented.

Figure 1:
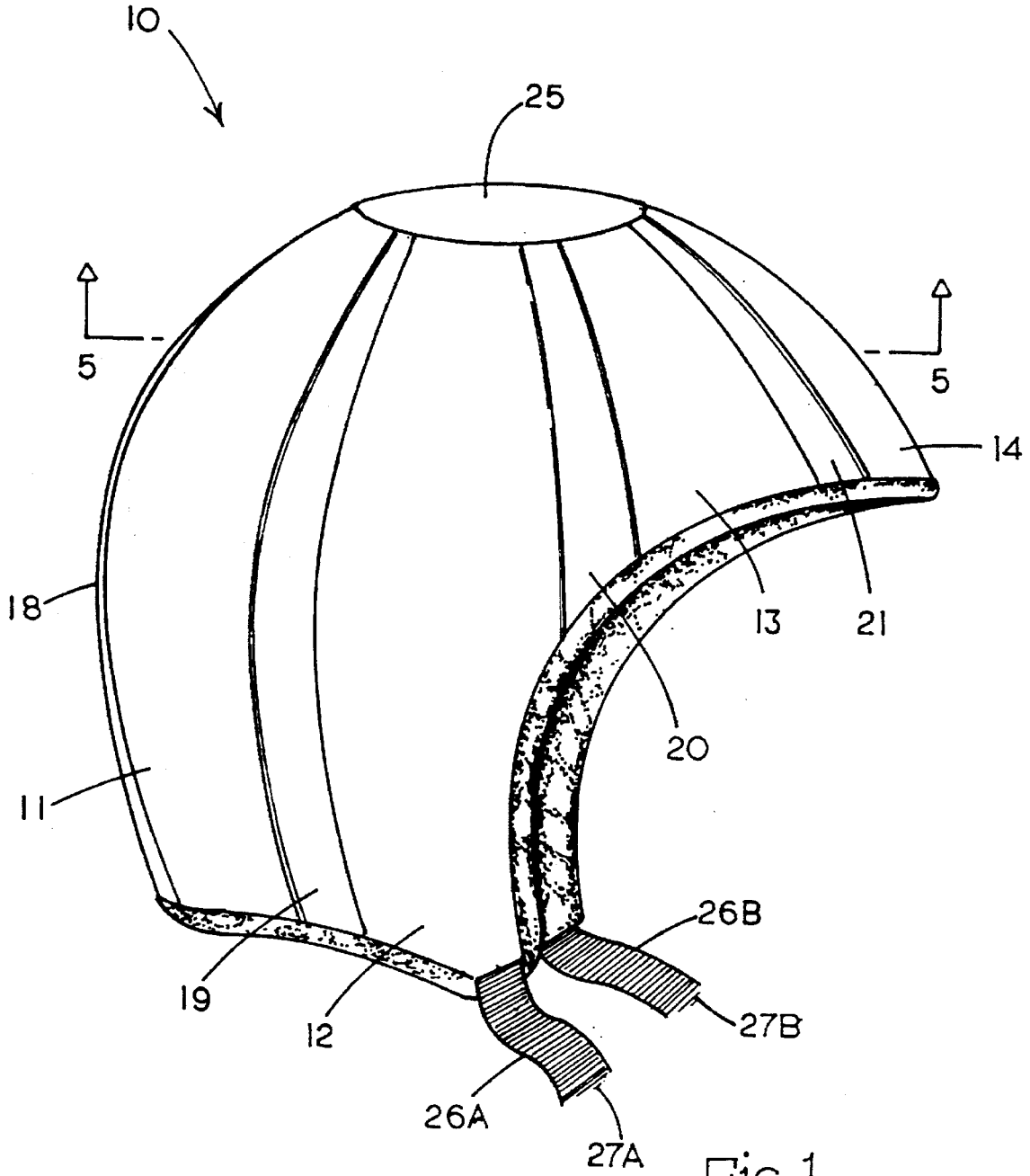
FIG. 1 is a side elevational view of the helmet from the wearer's right side.
Figure 2:
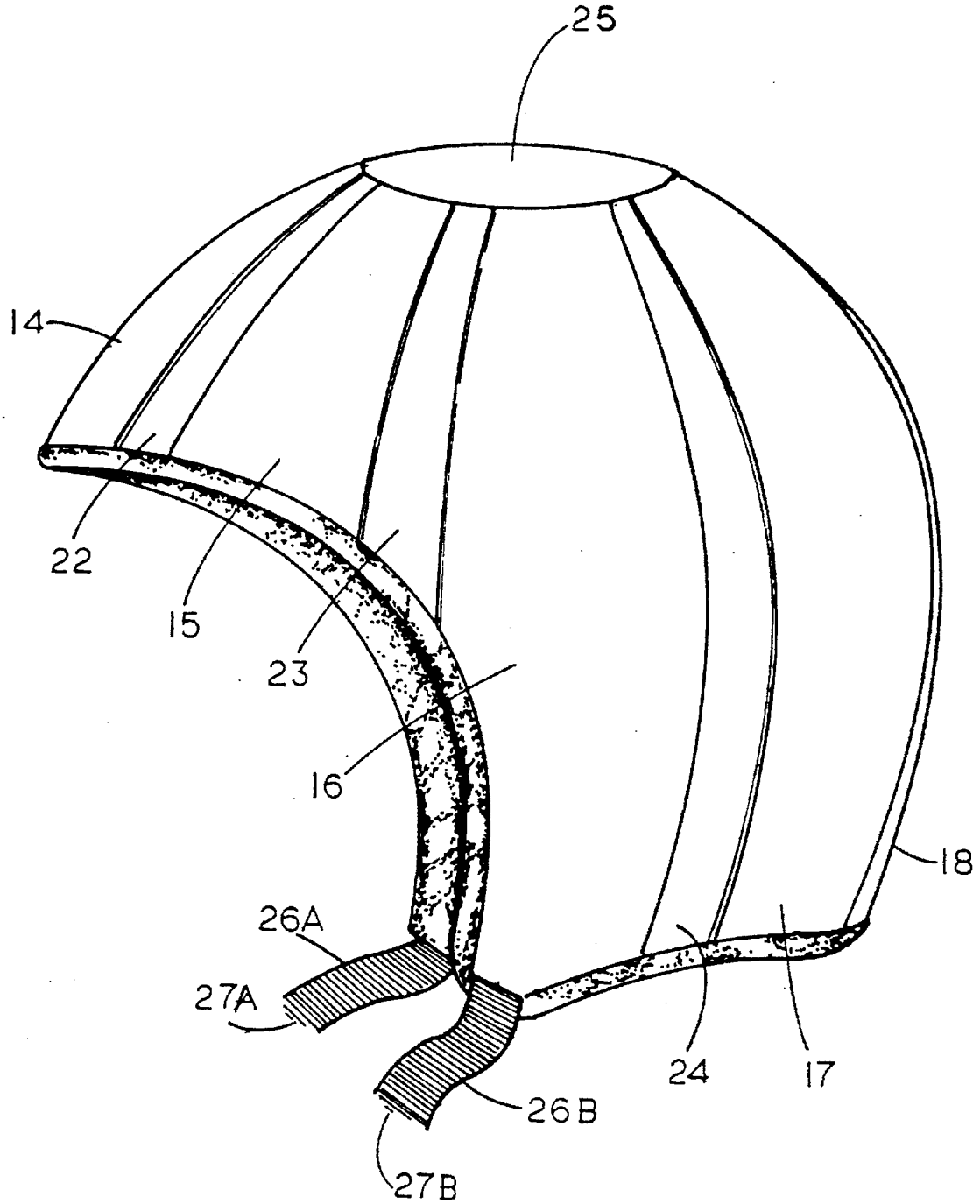
FIG. 2 is a side elevational view of the helmet from the wearer's left side.
Figure 3:
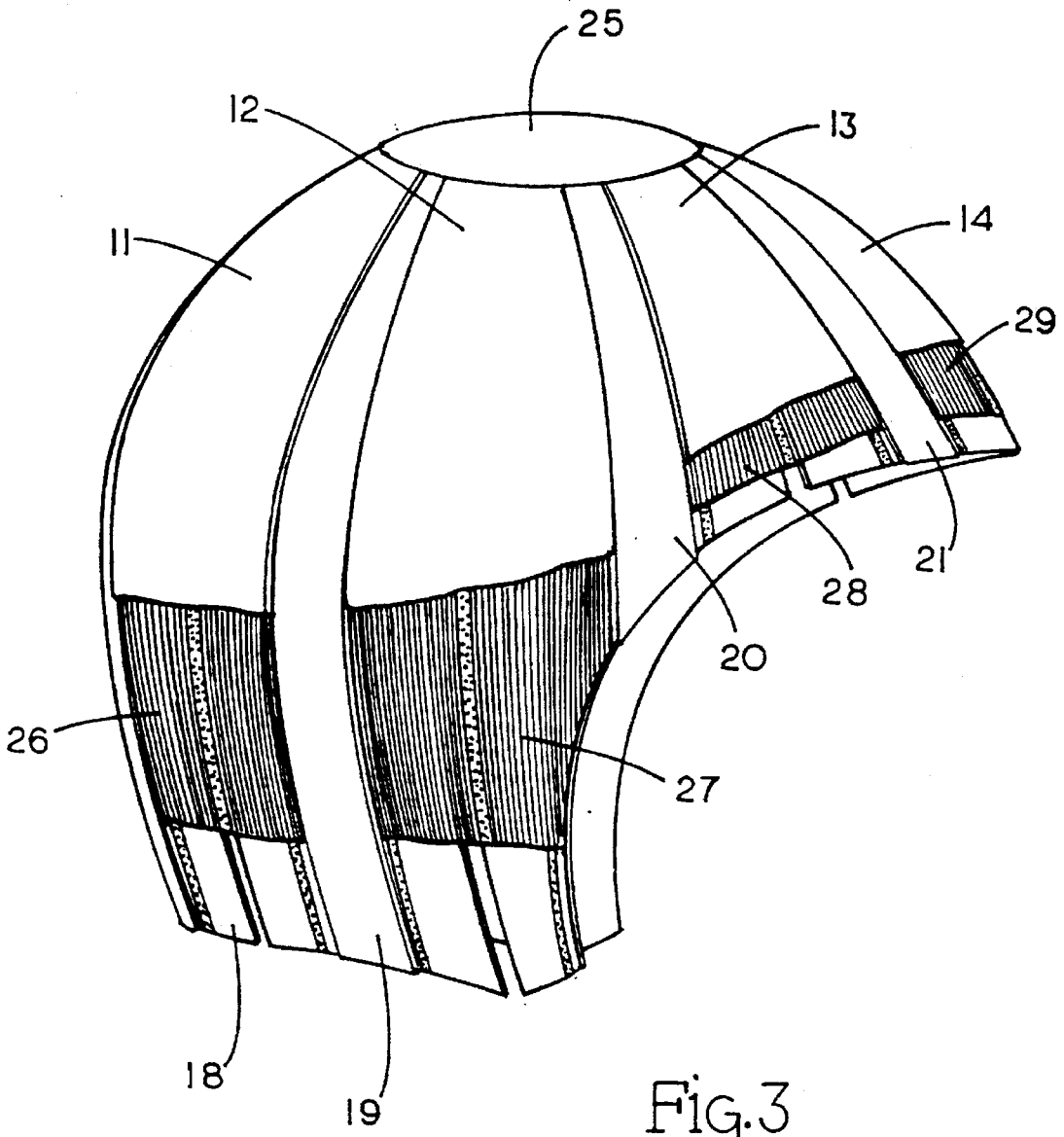
FIG. 3 is a side elevational cutaway view of the helmet from the wearer's right side illustrating the arrangement of structures, elastic panels, and segments.
Figure 4:
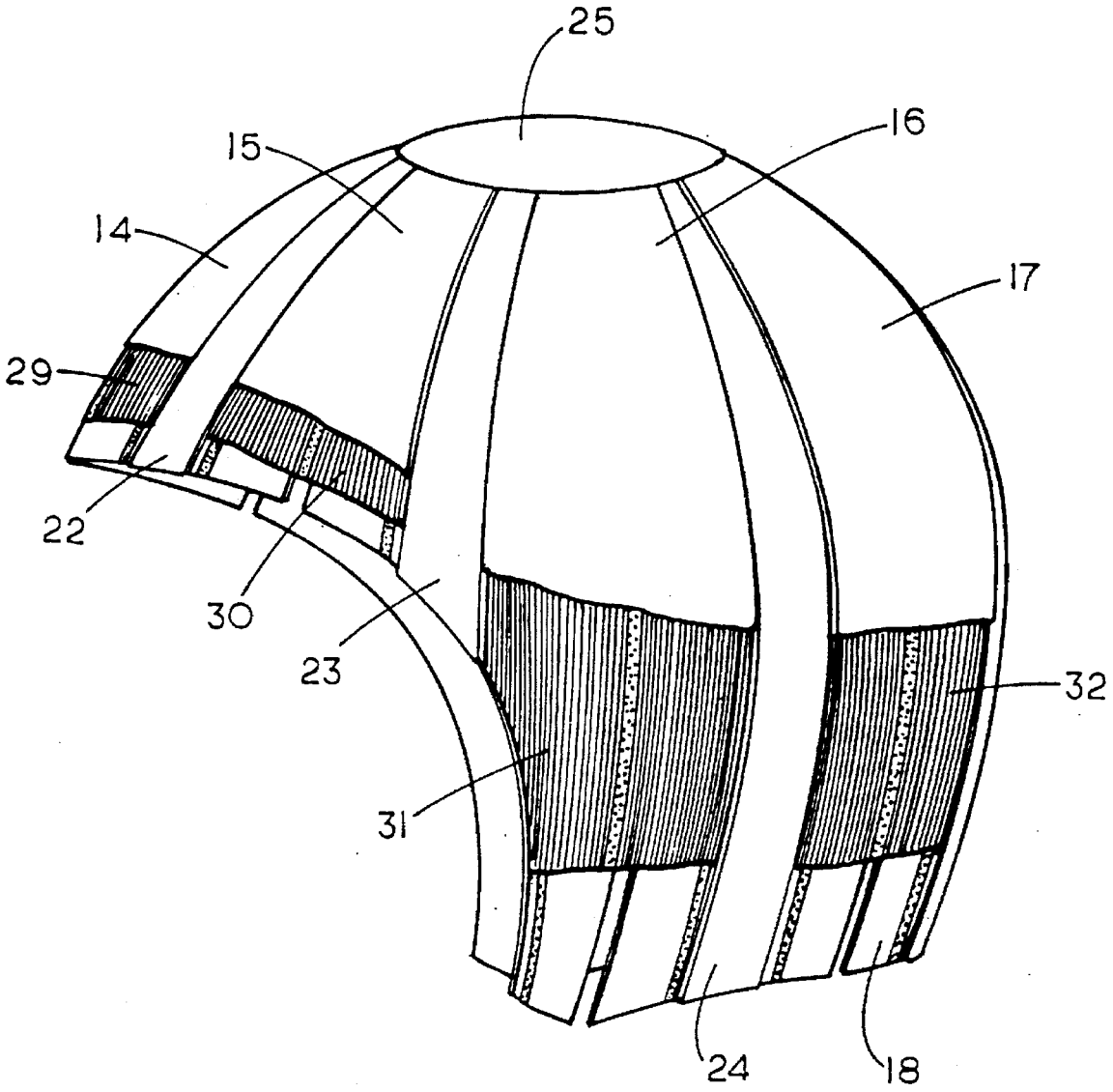
FIG. 4 is a side elevational cutaway view of the helmet from the wearer's left side illustrating the arrangement of structures, elastic panels, and segments.
Figure 5:
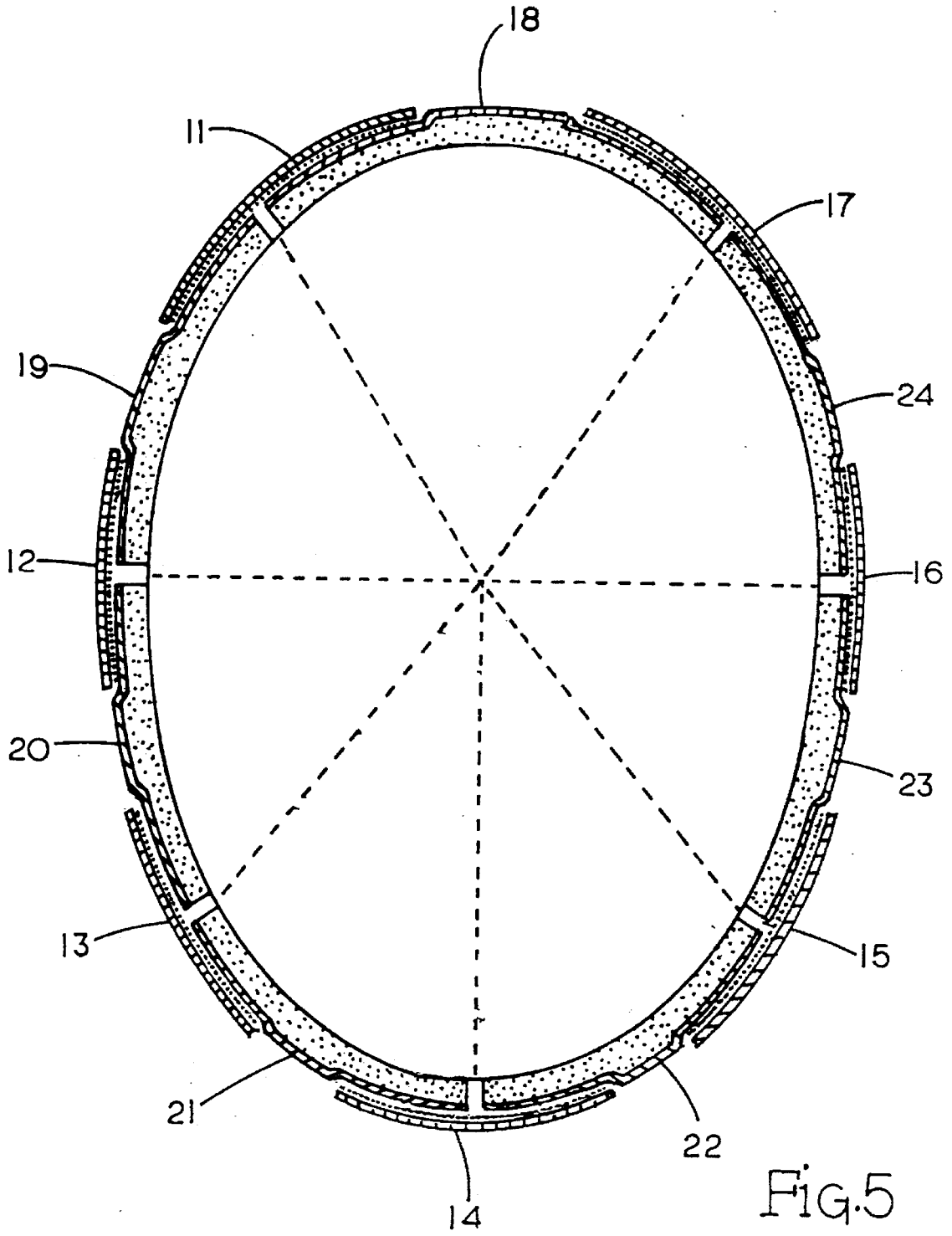
FIG. 5 is a fragmentary plan view of the arrangement of structures, elastic panels, and segments of the helmet taken along line 5—5 of FIG. 1.
Figure 6:
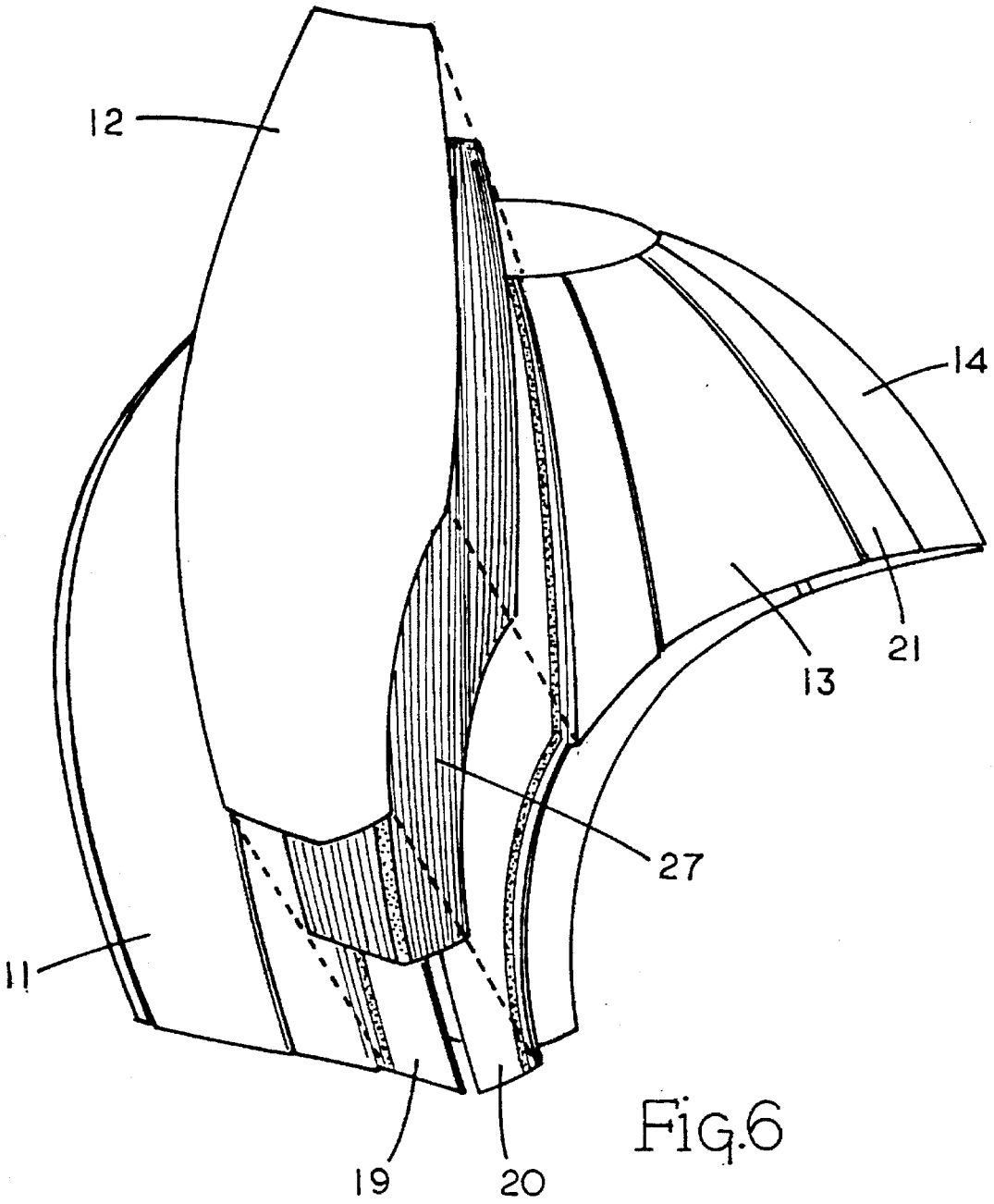
FIG. 6 is a side elevational exploded view typical of the arrangement of structures, elastic panels, and segments.
Figure 7:
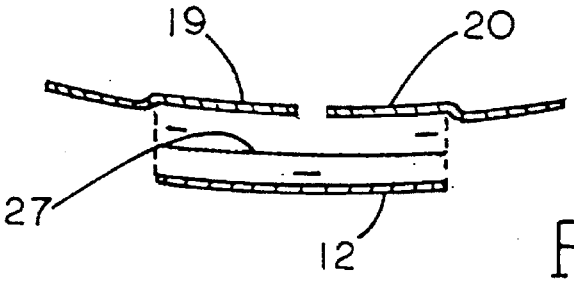
FIG. 7 is an exploded plan view of the arrangement depicted in FIG. 6.

Referring now to FIG. 1 there is shown a protective flexible helmet generally represented by numeral 10 which comprises an inner layer of relatively rigid, impact absorbent structures 18, 19, 20, 21, 22, 23, and 24 fixedly attached to each other by panels of elastic material 26, 27, 28, 29, 30, 31, and 32 as best shown in FIGS. 3 and 4. Overlying the inner layer of structures is an outer layer of segments 11, 12, 13, 14, 15, 16, and 17 as best shown in FIGS. 1 and 2 which are fixedly attached to the inner layer of structures by the elastic panels shown in FIGS. 3 and 4. An elliptically annular crown structure 25 is fixedly attached to the inner layer of structures by the upper lateral margins of the elastic panels as best shown in FIGS. 3 and 4. The helmet includes an adjustable chinstrap 26A and 26B as shown in FIGS. 1 and 2, which incorporates conventional releaseable hardware (not shown) attached to its' distal ends 27A and 27B.

The inner layer structures are each formed in part, of a relatively rigid hemisphereical planar segment of material, each shaped appropriately for its' particular location. While having an overall uniformity, these segments may vary in thickness or density depending on the degree of impact resistance desired in a particular embodiment of the invention. They may be formed from any one or combination of, various plastics, fiberglass, composite resins, or metal depending on the degree of rigidity and impact resistance or other properties desired in a particular embodiment. Laminated or cemented to the inner surface of each segment is a layer of energy absorbent material or padding oriented such that in the completed assembly this padding will be adjacent to the interior of the helmet and the wearer's head. This padding, while having an overall uniformity in the current invention, may also vary in thickness or density depending on the degree of energy absorbing ability desired in a particular embodiment of the invention. This padding may be formed from for example, any one or combination of crushable polystyrene, various synthetic expanded foams such as polyurethane, polypropelene, or polyvinyl, various synthetic or natural rubber compounds, or other suitable material with properties desired in a particular embodiment of the invention.

Elastic panels as best shown in FIGS. 3 and 4, are formed from flexible, elastic textile fabric or an elastic sheet form of material with elastic properties similar to or including synthetic or natural rubber. In the preferred embodiment of the invention these elastic panels, as best shown in FIGS. 3 and 4, are fixedly attached to the inner layer of structures such that one panel is common to the longitudinal margins of adjacent abutting structures. Each panel is fixedly attached to the outer surface of each of these structures extending substantially throughout their entire longitudinal margins. The elastic panels thereby restrict the inner layer structures to the above abutting configuration while permitting limited flexible, elastic movement of the structures. The elastic panels also fixedly attach the inner layer structures to the inner surface of the perimeter margins of the impact resistant segment of an elliptically annular crown structure included in the helmet as best shown in FIGS. 3 and 4, along the upper lateral margins of these structures. The impact resistant segment of the crown structure therefore extends over the upper lateral margins of the inner layer structures in an overlapping configuration as best shown in FIGS. 3 and 4 providing structurally contiguous resistance to impacts at those locations.

The inner layer structures are shaped and dimensioned such that they extend longitudinally from the crown structure in an arcuate radial manner, forming the lower margins of the helmet. They are also shaped and dimensioned in their lateral aspects such that in concert with each other they extend along the entire perimeter of the crown structure and laterally along substantially the entire circumference of the helmet. This arrangement of the inner layer structures, along with the crown structure, thereby forms a contiguous inner helmet body.

The outer layer of segments, formed of the same material as described above to form the segments of the inner layer structures, are shaped and dimensioned such that they extend longitudinally from close abutment with the perimeter of the crown chamber to the lower margins of the helmet as best shown in FIGS. 1 and 2. They are shaped and dimensioned such that each extends laterally beyond and overlies the longitudinal abutting margins of adjacent inner layer structures. The longitudinal central aspects of each outer layer segment is positioned adjacent to the longitudinal abutting margins of adjacent inner layer structures, therefore providing structurally contiguous resistance to impacts at those positions. The elastic panels show in FIGS. 3 and 4 attach each of the outer layer segments along their central longitudinal aspects to the inner layer of structures and therefore do not inhibit or restrict the limited flexible and elastic movement of the inner layer structures. In the preferred embodiment of the invention the outer layer segments do not extend laterally such that their longitudinal margins are abutting as shown in FIGS. 1 and 2. The central longitudinal aspects of the inner layer structures are therefore exposed between adjacent overlying outer layer segments, the dimensions of these areas to be determined by the particular embodiment of the helmet desired. Chinstrap sections 26A and 26B may be attached to outer layer segments 12 and 16 as shown in FIGS. 1 and 2 prior to assembly by mechanical or other means (not shown) with conventional releaseable hardware (not shown) attached to its' distal ends 27A and 27B, thereby securely fastening the helmet in place on the wearer's head.

The elliptically annular crown structure 25 is positioned such that its' greater planar dimension is substantially in alignment with the saggital (anterior-posterior) plane of the helmet.

Assembly of the helmet in the described embodiment consists in part of applying an adhesive chemical compound to the extremities of the longitudinal margins of each of the elastic panels and applying them in their respective locations to the inner layer structures as shown in FIGS. 3 and 4 thereby fixedly attaching abutting structures to each other. Adhesive is applied to the upper lateral margins of the elastic panels and the crown structure placed in its' respective position fixedly attaching it to the helmet as shown in FIGS. 3 and 4. Adhesive is then applied to the central longitudinal aspects of each of the elastic panels shown in FIGS. 3 and 4. Each of the outer layer segments are then applied in their respective positions as shown in FIGS. 1 and 2, fixedly attaching them to the helmet.

The current invention avoids entirely the concepts of the prior art as regards protective helmets by providing a series of integral, fixedly attached overlapping segments and structures in a flexible, elastic assembly significantly reducing bulk to a minimum while providing maximum response to the wearer's head shape and size. It will therefore be apparent to one skilled in the art of helmet design and construction that the invention accomplishes all of its' objectives.

It is to be understood that details and terminology of the above description are not to be construed as limitations of the invention, but rather as an exemplification of the preferred embodiment. Without departing from the true scope of the claims, details, materials, and configuration are subject to change. Accordingly, the scope of the invention should be determined not by the embodiment illustrated and described, but by the appended claims and their legal equivalents.

Having described the invention, that which I claim is:

1. A flexible protective helmet assembly comprising a plurality of relatively rigid discreet impact resistant and energy absorbent structures arranged into an inner layer of structures, a plurality of relatively rigid impact resistant fixedly attached segments arranged into an outer layer of segments, flexible elastic material fixedly attaching said structures to abutting structures of said inner layer of structures and fixedly attaching said segments to said inner layer of structures, said flexible elastic material selected from a group consisting of flexible elastic textile fabric and flexible elastic sheet form material, wherein the upper lateral margins of said structures form a crown area, and wherein means are included fixedly attaching said flexible elastic material to said structures and to said segments, said means including an adhesive chemical compound, whereby said helmet provides a wearer protection from impacts substantially equivalent to that provided by helmets employing and comprising in part substantially unitary relatively rigid outer shells.

2. An assembly as in claim 1, wherein said inner layer of structures form the lower margins of said helmet, each structure of said inner layer of structures extends longitudinally from said crown area to said lower margins of said helmet, and each segment of said outer layer of segments extends longitudinally from said crown area to said lower margins of said helmet.

3. An assembly as in claim 1, wherein central longitudinal aspects of the segments of said outer layer of segments are substantially in alignment with and adjacent longitudinal abutments of said structures of said inner layer of structures, and longitudinal margins of the segments of said outer layer of segments extend beyond and overly longitudinal margins of the structures of said inner layer of structures.

4. An assembly as in claim 1, wherein central longitudinal aspects of each of structures of said inner layer of structures is exposed between the longitudinal margins of segments of said outer layer of segments.

5. An assembly as in claim 1 further including a relatively rigid impact resistant and energy absorbent crown structure fixedly attached to said helmet by said flexible elastic material, and means are included for attaching said crown structure to said flexible elastic material including an adhesive chemical compound.

6. A crown structure as in claim 5, wherein said crown structure has a perimeter which extends beyond and overlies upper lateral margins of each of the structures of said inner layer of structures of said helmet.

7. A crown structure as in claim 5, wherein said crown structure is elliptically annular in shape and the greater planar dimension of said crown structure is substantially in alignment with the sagittal longitudinal plane of said helmet.

8. An assembly as in claim 1 further including a releaseably securable adjustable chinstrap, and means for attaching said chinstrap to said helmet.

* * * * *